US008409705B2

(12) United States Patent
Spinks

(10) Patent No.: US 8,409,705 B2
(45) **Date of Patent: *Apr. 2, 2013**

(54) RAINBOW FIBRES

(75) Inventor: Gary D Spinks, London (GB)

(73) Assignee: D.W. Spinks (Embossing) Ltd., London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/351,754

(22) Filed: Jan. 17, 2012

(65) Prior Publication Data

US 2012/0111518 A1 May 10, 2012

Related U.S. Application Data

(63) Continuation of application No. 10/527,650, filed as application No. PCT/GB03/03706 on Aug. 28, 2003, now Pat. No. 8,158,253.

(30) Foreign Application Priority Data

Sep. 16, 2002 (GB) ..... 0221449.2

(51) Int. Cl.

| | |
|---|---|
| ***B32B 19/00*** | (2006.01) |
| ***D21H 11/00*** | (2006.01) |
| ***B42D 15/00*** | (2006.01) |
| ***G09C 3/00*** | (2006.01) |
| ***D21F 13/00*** | (2006.01) |

(52) U.S. Cl. ..... 428/357; 428/311.51; 428/311.71; 428/199; 428/393; 428/195.1; 428/35.6; 428/191; 428/207; 428/153; 428/154; 283/57; 283/67; 283/83; 283/91; 380/54; 162/103; 162/104; 162/124; 162/134; 162/140; 162/135

(58) Field of Classification Search ..... 428/357, 428/311.51, 311.71, 199, 393, 195.1, 35.6, 428/191, 207, 153, 154; 283/57, 67, 83, 283/91; 380/54; 162/103, 104, 124, 134, 162/140, 135

See application file for complete search history.

(56) References Cited

U.S. PATENT DOCUMENTS

| | | | |
|---|---|---|---|
| 2,032,385 | A | 3/1936 | Wood |
| 2,208,653 | A | 7/1940 | Whitehead |

(Continued)

FOREIGN PATENT DOCUMENTS

| | | | |
|---|---|---|---|
| DE | 449133 | | 9/1927 |
| EP | 0 342 929 | A | 11/1989 |

(Continued)

OTHER PUBLICATIONS

Security Papers UK paper "Additional Substrate Security" from 2002 conference in Thailand.

*Primary Examiner* — Jennifer A Chriss
*Assistant Examiner* — Altrev Sykes
(74) *Attorney, Agent, or Firm* — Frommer Lawrence & Haug LLP; Ronald R. Santucci; Vivek Shankam

(57) ABSTRACT

Fibers having a plurality of colored regions printed on front and rear sides of said fiber are disclosed, wherein the colors are visible only under ultra-violet light. The regions may be in the form of stripes or may be arranged in a pseudo-random pattern. The regions may be differently colored. Such fibers can be incorporated into paper products as a form of counterfeit protection.

24 Claims, 1 Drawing Sheet

U.S. PATENT DOCUMENTS

| | | | |
|---|---|---|---|
| 3,898,035 | A | 8/1975 | Tillotson |
| 4,451,521 | A | 5/1984 | Kaule et al. |
| 4,655,788 | A | 4/1987 | Jalon |
| 4,756,557 | A | 7/1988 | Kaule et al. |
| 4,897,300 | A | 1/1990 | Boehm |
| 5,447,335 | A | 9/1995 | Haslop |
| 5,565,276 | A | 10/1996 | Murakami et al. |
| 5,744,000 | A | 4/1998 | Athey et al. |
| 5,770,110 | A | 6/1998 | Schrell et al. |
| 5,868,432 | A | 2/1999 | Mantegazza |
| 6,054,021 | A | 4/2000 | Kurrle et al. |
| 7,122,248 | B2 | 10/2006 | Tam et al. |

FOREIGN PATENT DOCUMENTS

| | | | | |
|---|---|---|---|---|
| EP | 0 388 090 | A | | 9/1990 |
| EP | 0 428 489 | A | | 5/1991 |
| EP | 0 520 060 | A | | 12/1992 |
| FR | 2 819 831 | | | 7/2002 |
| GB | 237828 | | | 2/1925 |
| GB | 440421 | | | 6/1934 |
| GB | 1095286 | | | 12/1967 |
| JP | 02-293500 | A | | 12/1990 |
| JP | 2002/293500 | | | 12/1990 |
| JP | 02293500 | A | * | 12/1990 |
| JP | 05-098599 | A | | 4/1993 |
| WO | WO 94/24370 | | | 10/1994 |
| WO | WO 95/09947 | A | | 4/1995 |
| WO | WO 99/45200 | | | 9/1999 |

* cited by examiner

RAINBOW FIBRES

This application is a continuation of U.S. patent application Ser. No. 10/527,650 filed Sep. 23, 2005 entitled "Rainbow Fibres" which is a 371 filing of International Application PCT/GB2003/003706 filed Aug. 28, 2003 which claims priority benefits to British Application Number 0221449.2 filed Sep. 16, 2002, the disclosures of all of which are incorporated herein by reference.

The present invention relates to fibres having a number of coloured fluorescent stripes or regions that are visible only under ultra-violet light. The present invention also relates to paper products incorporating such fibres.

It is known to provide a number of paper products, such as bank notes, cheques, passports, identity papers and fiduciary papers, with some form of counterfeit protection. A number of counterfeit protection measures are known in the art.

They include watermarks, holograms, the provision of metallic strips through the paper, the use of fluorescent particles and the use of optically variable inks and coatings.

Problems with known counterfeit protection measures include the expense of some options and the ease with which some options can be overcome, for example by utilizing methods including digital or laser printing, scanning, photography and xerography. Another problem is the difficulty in raising public awareness of some of the measures, especially in relation to counterfeit protection for bank notes.

It is an object of the present invention to provide an alternative means of providing counterfeit protection that addresses at least some of the above-mentioned problems.

The present invention provides a fibre having a front side and a rear side and having a plurality of striped regions printed on said front and rear sides, wherein said striped regions are coloured and the colours are visible only under ultra-violet light, said stripes including stripes having two or more colours. The stripes may include stripes having at least three colours. In one embodiment, four colours are used. The colours may include at least some of red, yellow, blue and green.

The fibre may comprise only two stripes, with each stripe having a different colour. In one embodiment of the invention, two stripes are provided with each covering half of the fibre. The stripes are preferably printed on the front and rear sides of the fibre such that stripes on the front and rear sides are in register with one another and have the same colour. This ensures that, if the fibres are incorporated into a paper product, the printed stripes will be visible, given the appropriate light conditions, regardless of the orientation of the fibre in the paper product. In one preferred embodiment, the stripes abut one another with no overlap of colour at the boundaries of the stripes. The pigments used for generating the printed stripes do not generally combine well, hence the desire to prevent the printed stripes from overlapping. Further, if the fibres are incorporated into a paper product, the provision of fluorescent printed stripes that abut against one another exactly results in a pattern that is difficult to replicate, thereby offering good counterfeit protection.

The stripes may be placed at about 1 mm gradations. The width of the stripes can be more or less than 1 mm, but it has been found that 1 mm results in a particularly effective optical effect when the fibres are incorporated into a paper product. Hence, a width of the order of 1 mm (0.5 to 1.5 mm) may advantageously be chosen since it offers good counterfeit protection.

The dimensions of the fibres themselves can be varied. Typical lengths that have been used are 3 mm, 4 mm, 5 mm, 6 mm, 7 mm, 8 mm, 9 mm and 10 mm. Typical widths that have been used are 0.125 mm, 0.15 mm, 0.2 mm, 0.25 mm, 0.3 mm, 0.35 mm, 0.4 mm, 0.45 mm and 0.5 mm.

The fibre may be tissue paper or an alternative thin paper. The paper may be provided without optical brighteners.

The present invention also provides a fibre having a front side and a rear side and having a plurality of regions printed on said front and rear sides, wherein said regions are coloured and the colours are visible only under ultraviolet light.

The regions may include regions having two colours. The fibre may comprise only two regions, with each region having a different colour. In one embodiment of the invention, two regions are provided with each covering half of the fibre.

The regions may include regions having at least three colours. In one preferred embodiment, the regions include regions having at least four colours. The colours may include at least some of red, yellow, blue and green.

The regions are preferably printed on the front and rear sides of the fibre such that regions on the front and rear sides are in register with one another and have the same colour. This ensures that, if the fibres are incorporated into a paper product, the printed regions will be visible, given the appropriate light conditions, regardless of the orientation of the fibre in the paper product.

The regions may abut one another with no overlap of colour at the boundaries of the regions. As noted above, the pigments used for generating the printed regions do not generally combine well, hence the desire to prevent the printed regions from overlapping. Further, if the fibres are incorporated into a paper product, the provision of fluorescent printed regions that abut against one another exactly results in a pattern that is difficult to replicate, thereby offering good counterfeit protection.

The printed regions may be arranged in a pseudo-random pattern, which may be computer generated. This increases the counterfeit protection of a paper product incorporating such a fibre.

The fibre may be tissue paper or an alternative thin paper. The paper may be provided without optical brighteners.

The printed stripes or regions may appear in a repeating pattern, for example by providing stripes that appear in the same order. The fibre may be cut from a larger fibre. For example, a long fibre having a repeating pattern of printed stripes or regions may be cut into a number of smaller fibres. These smaller fibres may be cut in a random or pseudo-random fashion so that the pattern of printed stripes or regions in each fibre starts and finishes in a different place. The effect of cutting the fibres in this manner is to provide a number of different fibres that can be used to create an unpredictable pattern when incorporated into a paper product. The provision of a plurality of fibres in a paper product, each fibre having a series of stripes or regions starting in a different position can result in an overall pattern that is unpredictable and difficult to replicate, yet relatively straightforward to describe.

A fibre in accordance with the present invention may have a layer of varnish applied to the outer surface of the fibre. The provision of a layer of varnish may be applied to protect the printed stripes or regions against abrasion and/or to improve the affinity of the fibres with a paper product into which the fibre is incorporated.

The present invention also provides a method of manufacturing a fibre, the method comprising the steps of printing a plurality of striped regions on front and rear sides of the fibre, wherein said striped regions are coloured and the colours are visible only under ultra-violet light, said stripes including stripes having two or more colours. The stripes may include stripes having three or more colours. In one embodiment, the stripes include four colours. The colours may include at least some of red, yellow, blue and green.

The fibre manufactured by the present invention may comprise only two stripes, with each stripe having a different colour. In one embodiment of the invention, two stripes are provided with each covering half of the fibre.

The step of printing said plurality of striped regions preferably includes the step of printing on the front and rear sides of the fibre such that stripes on the front and rear sides are in register with one another and have the same colour. This ensures that, if the fibres are incorporated into a paper product, the printed regions will be visible, given the appropriate light conditions, regardless of the orientation of the fibre in the paper product.

The stripes may abut one another with no overlap of colour at the boundaries of the stripes. As noted above, the pigments used for generating the printed stripes do not generally combine well, hence the desire to prevent the printed stripes from overlapping. Further, if the fibres are incorporated into a paper product, the provision of fluorescent printed stripes that abut against one another exactly results in a pattern that is difficult to replicate, thereby offering good counterfeit protection.

The stripes may be placed at about 1 mm gradations. The width of the stripes can be more or less than 1 mm, but it has been found that 1 mm results in a particularly effective optical effect when the fibres are incorporated into a paper product. Hence, a width of the order of 1 mm (0.5 to 1.5 mm) may advantageously be chosen since it offers good counterfeit protection.

The dimensions of the fibres themselves can be varied. Typical lengths that have been used are 3 mm, 4 mm, 5 mm, 6 mm, 7 mm, 8 mm, 9 mm and 10 mm. Typical widths that have been used are 0.125 mm, 0.15 mm, 0.2 mm, 0.25 mm, 0.3 mm, 0.35 mm, 0.4 mm, 0.45 mm and 0.5 mm.

The fibre may be tissue paper or an alternative thin paper. The paper may be provided without optical brighteners.

The present invention further provides a method of manufacturing a fibre, the method comprising the steps of printing a plurality of regions on front and rear sides of said fibre, wherein said regions are coloured and the colours are visible only under ultra-violet light.

The regions may include regions having at least two colours. In one preferred embodiment, the regions include regions having at least four colours. The colours may include at least some of red, yellow, blue and green.

The fibre manufactured may comprise only two regions, with each region having a different colour. In one embodiment of the invention, two regions are provided with each covering half of the fibre.

The regions are preferably printed on the front and rear sides of the fibre such that regions on the front and rear sides are in register with one another and have the same colour. This ensures that, if the fibres are incorporated into a paper product, the printed regions will be visible, given the appropriate light conditions, regardless of the orientation of the fibre in the paper product.

The regions may abut one another with no overlap of colour at the boundaries of the regions. As noted above, the pigments used for generating the printed regions do not generally combine well, hence the desire to prevent the printed regions from overlapping. Further, if the fibres are incorporated into a paper product, the provision of fluorescent printed regions that abut against one another exactly results in a pattern that is difficult to replicate, thereby offering good counterfeit protection.

The printed regions are preferably arranged in a pseudo-random pattern which may be computer generated. This increases the counterfeit protection of a paper product incorporating such a fibre.

The fibre may be tissue paper or an alternative thin paper. The paper may be provided without optical brighteners.

The printed stripes or regions may appear in a repeating pattern, for example by providing stripes that appear in the same order. The fibre may be cut from a larger fibre. For example, a long fibre having a repeating pattern of printed stripes or regions may be cut into a number of smaller fibres. These smaller fibres may be cut in a random fashion so that the pattern of printed stripes or regions in each fibre starts and finishes in a different place. The effect of cutting the fibres in this manner is to provide a number of different fibres that can be used to create an unpredictable pattern when incorporated into a paper product. The provision of a plurality of fibres in a paper product, each fibre having a series of stripes or regions starting in a different position can result in an overall pattern that is unpredictable and difficult to replicate, yet relatively straightforward to describe.

The method of manufacturing a fibre may include the step of applying a layer of varnish to the outer surface of the fibre. The application of a layer of varnish protects the printed stripes or regions against abrasion and may be used to improve the affinity of the fibres with a paper product into which the fibre is incorporated.

The present invention also provides a method of manufacturing a paper product, the method comprising the steps of mixing any of fibres described above with slurry paper pulp such that the fibres form a hydrogen bond with the cellulose fibre in the paper pulp and forming the paper pulp and fibre mix into a continuous web of paper.

The present invention further provides a paper product containing a plurality of the fibres described above.

By way of example only, embodiments of the present invention will now be described with reference to the accompanying drawings, of which:

Figure 1:
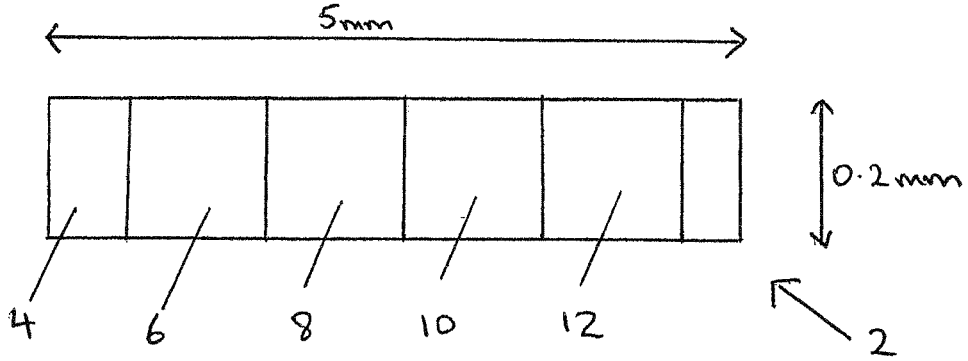
FIG. 1 shows a fibre in accordance with a first embodiment of the invention.

FIG. 1 shows a fibre, indicated generally by the reference numeral 2, in accordance with a first embodiment of the present invention. The fibre 2 includes stripes 4, 6, 8, 10 and 12 each extending across the width of the fibre; the stripes are each 1 mm long and the series of stripes extends across the length of the fibre.

The fibre shown in FIG. 1 is 5 mm long and 0.2 mm wide but other dimensions are possible.

Each stripe has a fluorescent colouring that is only visible under ultra-violet light. Each fibre includes stripes having at least two different colours, such as red, yellow, blue and green. In one embodiment, the colours are visible when ultra-violet light having a wavelength between 245 nm and 365 nm is shone at the fibre. In any particular embodiment, and for any particular colour, the wavelengths at which the colours are visible are dependent on the pigments used to generate the prints.

The coloured stripes are printed on both sides of the fibre and are exactly in register such that each colour appears exactly over the corresponding colour on the other side of the fibre. Further, the coloured stripes abut one another such that there is no overlap of colours at the boundary of the stripes.

The fibres are produced so that the coloured stripes appear in the same order in a repeating pattern. However, the array of stripes starts and finishes in a random or pseudo-random fashion so that the fibres differ from one another. In the manufacturing process, the fibres are cut to the same length (e.g. 3 mm, 5 mm or 6 mm depending on the length chosen) but the fibres are presented to the cutting equipment such that the cut appears at different positions relative to the repeated printing pattern, thereby producing a random or pseudo-random cut.

In a variant of the first embodiment of the invention, only two stripes are provided on the fibre, with each stripe having a different colour. In a further variant, two stripes are provided with each covering half of the fibre.

Figure 2:
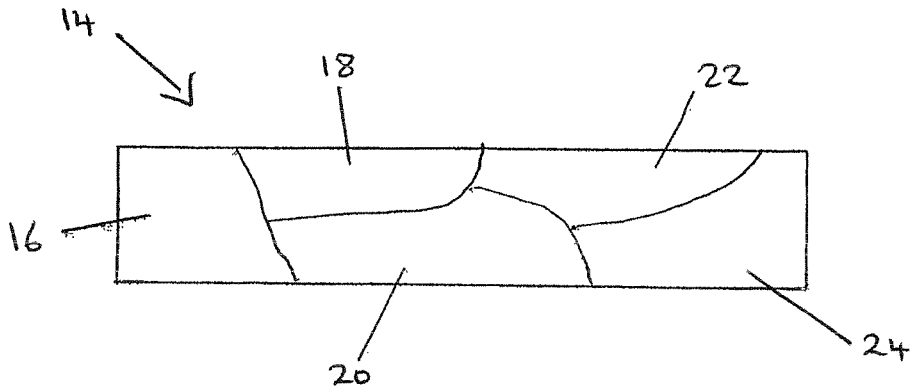
FIG. 2 shows a fibre in accordance with a second embodiment of the present invention.

FIG. 2 shows a fibre, indicated generally by the reference numeral 14, in accordance with a second embodiment of the present invention. The fibre 2 includes regions 16, 18, 20, 22 and 24 arranged in a pseudo-random fashion on the fibre. The pattern of the regions is generated by a computer program such that each pattern is different.

As with the stripes of the first embodiment, each region has a fluorescent colouring that is only visible under ultraviolet light. Each fibre includes regions having different colours, such as red, yellow, blue and green. As before, the colours may be visible when ultraviolet light having a wavelength between 245 nm and 365 nm is shone at the fibre.

As in the first embodiment, the coloured regions are printed on both sides of the fibre and are exactly in register such that each colour appears exactly over the corresponding colour on the other side of the fibre. Further, the coloured stripes abut one another such that there is no overlap of colours at the boundary of the regions.

In addition to the pseudo-random nature of the printed patterns, the fibres are, cut in a random or pseudo-random fashion in a similar manner to the fibres of the first embodiment.

The regions may include regions having only two different colours. In one variant of the second embodiment of the invention, only two regions are provided, with each region having a different colour. In a further variant, two regions are provided with each covering half of the fibre.

The fibres of the embodiments of the invention described above are manufactured from tissue or thin paper without optical brighteners. The optimum paper is a high porosity, high wet strength tissue paper with a nominal basis weight of 25 grams per square meter. The substance of the paper is significant since the ability to print and cut a thin material provides a technical barrier to duplicating the fibres.

Fibres in accordance with the present invention have been manufactured using paper having the properties listed below. These properties have been developed with the intention of providing a fibre that works well but are only one example. Other papers could be used.

| Properties | Units | Minimum | Maximum | Average |
|---|---|---|---|---|
| Substance | $g/m^2$ | 15 | 45 | 24.8 |
| Lemm capillary climb md | mm | 16 | 17 | 16.6 |
| Wet tensile strength | N/15 mm | 4.5 | 5.9 | 5.14 |
| Bulk | $Cm^3/g$ | 2.4 | 2.5 | 2.46 |
| High porosity | l/mn/lOO $cm^2$ | 24 | 31.2 | 27.9 |
| Humidity | % | 4.9 | 7.0 | 4.98 |
| pH of aqueous extract | | | | 6.8 |

In addition, the target Bensten porosity (defined by ISO standard 5636/3) is 1500 ml/mm, the minimum Bensten value is 700 ml/mm In one embodiment of the invention, four different coloured stripes or regions are used; those colours are red, yellow, green and blue. As noted above, the colours are printed onto the fibre. Suitable products for this printing process have been developed from commercially available pigments.

Each of the red, yellow, green and blue prints in the range has a minimum Blue Wool lightfastness of 3, an excitation wavelength in the region of 365 nm and good chemical resistance.

As noted above, fibres in accordance with the present invention can be incorporated into a paper product, such as a bank note, as a counterfeit protection device.

Paper products in accordance with the present invention are made by mixing slurry paper pulp with the fibres of the present invention. The fibres of the present invention form a hydrogen bond with the cellulose fibres in the paper pulp and when the pulp is formed into a continuous web of paper, the fibres in the pulp become an integral part of the web or sheet of paper. The coloured stripes or regions of the fibres can only be seen under ultra-violet light, thereby providing a security feature that cannot be seen in normal light conditions.

The substance of the fibres that are mixed with the slurry paper pulp are important since the use of a thin material improves the affinity of the fibres within the formed web of paper. This affinity can also be assisted by using a material with a high porosity. Furthermore, a material with a high wet tensile strength is an advantage since this will reduce the likelihood of the material disintegrating during the paper production process.

Before the fibres of the present invention are mixed with the paper, the fibres are coated with a varnish. The varnish protects the print against abrasion and also improves the affinity of the fibres in the finished paper. In one embodiment, the varnish used is a 4% solution of Solvitose NX in acrylic water based binder that is applied to both sides of the printed material.

In the embodiments of the invention described above, the print is applied to both sides of the fibre. This is advantageous since, in this finished paper product, the orientation of each individual fibre is unknown. If both sides of the fibre include the print, this will be visible regardless of which side is facing upwards.

The printed stripes or regions abut one another and do not overlap. Further, the pigments are selected so that there is no migration of colours into one another and no leeching or migration of the pigments into the surrounding paper.

The fibres incorporated into paper products are not visible in ordinary light conditions. Thus, the normal appearance of the paper product is not affected by the incorporation of the fibres into the paper.

The fibres according to the first embodiment of the invention are cut in different places to provide a range of different fibres and those fibres are incorporated into the paper in a range of different orientations and at different depths in the paper. The resulting pattern, when viewed under appropriate light conditions is very difficult to replicate and hence provides good counterfeit protection.

Further, fibres in accordance with the second embodiment of the invention have the added feature of pseudo-random printed patterns on the fibres to add an extra degree of randomness to the optical effect on the user. This extra complexity makes it even more difficult to replicate the optical effect.

In addition to being difficult to replicate, the optical effect is striking and relatively easy to describe to the general public.

What is claimed is:

1. A method of manufacturing a security fibre, the method comprising the steps of printing a plurality of regions on front and rear sides of fibre made of a paper without optical brighteners, wherein said regions are coloured and the colours are visible only under ultra-violet light, wherein at least two of said regions are coloured differently from each other, whereby the fibre is suitable for mixing with slurry paper pulp for paper formation.

2. A method as claimed in claim 1, wherein said regions are striped regions.

3. A method as claimed in claim 2, wherein said striped regions are placed at about 1 mm gradations.

4. A method as claimed in claim 2 and further comprising the step of printing the plurality of coloured striped regions in the same order in a repeating pattern.

5. A method as claimed in claim 2, wherein said fibre comprises only two striped regions, the first striped region having a first colour and the second striped region having a second colour.

6. A method as claimed in claim 5, wherein each of said striped regions covers half of said fibre.

7. A method as claimed in claim 2, wherein said striped regions include three or more differently coloured striped regions.

8. A method as claimed in claim 1, wherein the regions are arranged in a pseudo-random pattern.

9. A method as claimed in claim 8, wherein said fibre comprises only two regions.

10. A method as claimed in claim 9, wherein each of said regions covers half of said fibre.

11. A method as claimed in claim 8, wherein said regions include three or more differently coloured regions.

12. A method as claimed in claim 1, wherein the regions are printed such that regions on the front and rear sides are in register with one another and have the same colour.

13. A method as claimed in claim 1, wherein the regions abut one another with no overlap of colour at the boundaries of the regions.

14. A method as claimed in claim 1, wherein the fibre is cut from a larger fibre.

15. A method as claimed in claim 1, wherein the method further comprises the step of applying a varnish to the outer surface of the fibre.

16. A method as claimed in claim 1, wherein the fibre is manufactured from tissue paper.

17. A paper product containing a plurality of fibres manufactured using the method of claim 1.

18. A security fibre made of paper, wherein said paper is provided without optical brighteners, said fibre having a front side, a rear side, a length and a width, wherein a plurality of regions have print on said front and rear sides of said fibre, wherein said regions are coloured and the colours are visible only under ultra-violet light, whereby the fibre is suitable for mixing with slurry paper pulp for paper formation.

19. A security fibre made of paper, wherein said paper is provided without optical brighteners, said fibre having a front side, a rear side, a length, and a width, wherein a plurality of regions on front and rear sides of said fibre are coloured and the colours are visible only under ultra-violet light, whereby the fibre is suitable for mixing with slurry paper pulp for paper formation.

20. A method of manufacturing a security fibre, the method comprising the steps of printing a plurality of regions on front and rear sides of said fibre, wherein said regions are coloured and the colours are visible only under ultra-violet light, wherein at least two of said regions are coloured differently from each other, whereby the fibre is suitable for mixing with slurry paper pulp for paper formation, wherein said regions are striped regions, wherein said striped regions are placed at about 1 mm gradations.

21. A method of manufacturing a security fibre, the method comprising the steps of printing a plurality of regions on front and rear sides of said fibre, wherein said regions are coloured and the colours are visible only under ultra-violet light, wherein at least two of said regions are coloured differently from each other, whereby the fibre is suitable for mixing with slurry paper pulp for paper formation, wherein said regions are striped regions, wherein said fibre comprises only two striped regions, the first striped region having a first colour and the second striped region having a second colour.

22. A method of manufacturing a security fibre, the method comprising the steps of printing a plurality of regions on front and rear sides of said fibre, wherein said regions are coloured and the colours are visible only under ultra-violet light, wherein at least two of said regions are coloured differently from each other, whereby the fibre is suitable for mixing with slurry paper pulp for paper formation, wherein said regions are striped regions, wherein the regions are arranged in a pseudo-random pattern, wherein said regions include two differently coloured regions, wherein said fibre comprises only two regions.

23. A method of manufacturing a security fibre, the method comprising the steps of printing a plurality of regions on front and rear sides of said fibre, wherein said regions are coloured and the colours are visible only under ultra-violet light, wherein at least two of said regions are coloured differently from each other, whereby the fibre is suitable for mixing with slurry paper pulp for paper formation, wherein said regions are striped regions, wherein the regions abut one another with no overlap of colour at the boundaries of the regions.

24. A method as claimed in claim 20, 21, 22, or 23, wherein each of said regions covers half of said fibre.

* * * * *